US010590704B2

(12) United States Patent
Sue et al.

(10) Patent No.: US 10,590,704 B2
(45) Date of Patent: Mar. 17, 2020

(54) HIGH STRENGTH CORROSION RESISTANT HIGH VELOCITY OXY FUEL (HVOF) COATING FOR DOWNHOLE TOOLS

(75) Inventors: Jiinjen Albert Sue, The Woodlands, TX (US); Harold Sreshta, Conroe, TX (US); Rajagopala Pillai, Pasadena, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 1186 days.

(21) Appl. No.: 14/410,475

(22) PCT Filed: Jun. 28, 2012

(86) PCT No.: PCT/US2012/044531

§ 371 (c)(1), (2), (4) Date: Dec. 22, 2014

(87) PCT Pub. No.: WO2014/003751

PCT Pub. Date: Jan. 3, 2014

(65) Prior Publication Data

US 2015/0322719 A1 Nov. 12, 2015

(51) Int. Cl.

| | |
|---|---|
| ***C23C 4/06*** | (2016.01) |
| ***E21B 4/00*** | (2006.01) |
| ***C23C 4/12*** | (2016.01) |
| ***E21B 17/00*** | (2006.01) |
| ***C23C 30/00*** | (2006.01) |
| ***C22C 29/08*** | (2006.01) |

(Continued)

(52) U.S. Cl.

CPC ..... *E21B 4/003* (2013.01); *B22F 3/115* (2013.01); *B22F 7/04* (2013.01); *C22C 29/08* (2013.01); *C23C 4/06* (2013.01); *C23C 4/12* (2013.01); *C23C 30/00* (2013.01); *E21B 4/00* (2013.01); *E21B 4/02* (2013.01); *E21B 17/00* (2013.01); *B22F 2005/001* (2013.01); *Y10T 428/12972* (2015.01); *Y10T 428/256* (2015.01)

(58) Field of Classification Search

CPC ..... C23C 4/06; C23C 30/00; C23C 30/005

See application file for complete search history.

(56) References Cited

U.S. PATENT DOCUMENTS

| | | | |
|---|---|---|---|
| 4,136,230 | A | 1/1979 | Patel |
| 4,925,626 | A | 5/1990 | Anand et al. |

(Continued)

FOREIGN PATENT DOCUMENTS

| | | | |
|---|---|---|---|
| GB | 2376242 | A | 12/2002 |
| GB | 2433747 | A | 7/2007 |
| WO | 2008/076953 | A2 | 6/2008 |

OTHER PUBLICATIONS

U.K. Examination Report dated Nov. 28, 2016, for U.K. Application No. 1423150.0 (7 p.).

(Continued)

*Primary Examiner* — Kipp C Wallace

(74) *Attorney, Agent, or Firm* — Conley Rose, P.C.

(57) ABSTRACT

A downhole tool comprises a body made of a metal or metal alloy. In addition, the downhole tool comprises a coating disposed on the body. The coating includes at least 75 vol % tungsten carbide having an average grain size less than 1.0 μm. The content of tungsten carbide in the coating with a grain size less than 0.5 μm is between 40 and 64 vol % of the coating.

14 Claims, 8 Drawing Sheets

(51) Int. Cl.

| | |
|---|---|
| ***B22F 7/04*** | (2006.01) |
| ***E21B 4/02*** | (2006.01) |
| ***B22F 3/115*** | (2006.01) |
| *B22F 5/00* | (2006.01) |

(56) References Cited

U.S. PATENT DOCUMENTS

| | | | | |
|---|---|---|---|---|
| 5,535,838 | A * | 7/1996 | Keshavan | C23C 4/06 175/374 |
| 2002/0162691 | A1 | 11/2002 | Fang et al. | |
| 2005/0112411 | A1 | 5/2005 | Gray et al. | |
| 2010/0068405 | A1 | 3/2010 | Shinde et al. | |
| 2012/0171469 | A1 * | 7/2012 | Shmyreva | C23C 4/04 428/332 |
| 2013/0126773 | A1 * | 5/2013 | Ajdelsztajn | C23C 24/04 251/368 |

OTHER PUBLICATIONS

U.K. Examination Report dated Feb. 22, 2017, for U.K. Application No. 1423150.0 (3 p.).
Chinese Office Action dated Mar. 2, 2016, for Chinese Application No. 201280074396.3 (9 p.).
English Translation of Chinese Office Action dated Mar. 2, 2016, for Chinese Application No. 201280074396.3 (9 p.).
PCT/US2013/044531 International Search Report and Written Opinion dated Feb. 27, 2013 (13 p.).
Saha, Gobinda, et al., "The Corrosion and Wear Performance of Microcrystalline WC-10Co-4Cr and Near-Nanocrystalline WC-17Co High Velocity Oxy-Fuel Sprayed Coatings on Steel Substrate," Metallurgical and Materials Transactions, vol. 41A, Nov. 2010 (10 p.).
PCT/US2013/044531 Demand, Informal Comments, and Response to Written Opinion dated Feb. 27, 2013; Response filed May 21, 2013 (11 p.).
PCT/US2013/044531 Written Opinion dated Jul. 18, 2014 (6 p.).
PCT/US2013/044531 Response to Written Opinion dated Jul. 18, 2014; Response filed Aug. 18, 2014 (9 p.).
PCT/US2013/044531 Response to PCT Communication re: Written Opinion; Response filed Sep. 17, 2014 (9 p.).
Chinese Office Action dated Nov. 1, 2016, for Chinese Application No. 201280074396.3 (10 p.).
English Translation of Chinese Office Action dated Nov. 1, 2016, for Chinese Application No. 201280074396.3 (8 p.).
Zeng, Xiaoyan, "Distribution of Ceramic Phases in Laser-Cladded Ceramic-Metal Composite Coatings," Journal of Huazhong, University of Science and Technology, vol. 23, No. 12, Dec. 31, 1995 (5 p.).
Zhao, Minhai, et al., "Research on WC Reinforced Metal Matrix Composite," Soldering, No. 11, Dec. 31, 2006 (5 p.).
Examination and Search Report dated Nov. 14, 2018, for UAE Application No. 1436/2014 (12 p.).
Canadian Office Action dated Jun. 7, 2019, for Canadian Application No. 2,877,675 (3 p.).

* cited by examiner

HIGH STRENGTH CORROSION RESISTANT HIGH VELOCITY OXY FUEL (HVOF) COATING FOR DOWNHOLE TOOLS

CROSS-REFERENCE TO RELATED APPLICATIONS

This application is a 35 U.S.C. § 371 national stage application of PCT/US2012/044531 filed Jun. 28, 2012 and entitled "High Strength Corrosion Resistant High Velocity Oxy Fuel (HVOF) Coating for Downhole Tools," which is hereby incorporated herein by reference in its entirety for all purposes.

STATEMENT REGARDING FEDERALLY SPONSORED RESEARCH OR DEVELOPMENT

Not applicable

BACKGROUND

Field of the Invention

The invention relates generally to coatings to enhance the durability and operating lifetime of downhole tools and other devices. More particularly, the invention relates to high-velocity-oxy-fuel (HVOF) coatings applied to downhole tools and other devices to enhance strength, resistance to abrasive wear, resistance to corrosion, and resistance to spallation and cracking.

Background of the Technology

In drilling a borehole (or wellbore) into the earth, such as for the recovery of hydrocarbons or minerals from a subsurface formation, it is conventional practice to connect a drill bit onto the lower end of a "drill string", then rotate the drill bit while applying weight-on-bit to allow the bit to progress downward into the earth along a predetermined path to form a borehole. A typical drill string is made up from an assembly of drill pipe sections connected end-to-end, plus a "bottom hole assembly" (BHA) disposed between the bottom of the drill pipe sections and the drill bit. The BHA is typically made up of sub-components such as drill collars, stabilizers, reamers and/or other drilling tools and accessories, selected to suit the particular requirements of the well being drilled.

The drill string and bit are often rotated by means of either a "rotary table" or a "top drive" associated with a drilling rig erected at the ground surface over the borehole (or in offshore drilling operations, on a seabed-supported drilling platform or suitably-adapted floating vessel). During the drilling process, a drilling fluid (commonly referred to as "drilling mud" or simply "mud") is pumped under pressure downward from the surface through the drill string, out the drill bit into the wellbore, and then upward back to the surface through the annular space ("wellbore annulus") between the drill string and the wellbore. The drilling fluid carries borehole cuttings to the surface, cools the drill bit, and forms a protective cake on the borehole wall (to stabilize and seal the borehole wall), as well as other beneficial functions. At surface the drilling fluid is treated, by removing borehole cuttings, amongst other possible treatments, then re-circulated by pumping it downhole under pressure through the drill string.

As an alternative to rotation by a rotary table or top drive alone, a drill bit can also be rotated using a "downhole motor" incorporated into the BHA immediately above the drill bit. The technique of drilling by rotating the drill bit with a downhole motor without rotating the drill string is commonly referred to as "slide" drilling. It is common in certain types of well-drilling operations to use both slide drilling and drill string rotation, at different stages of the operation.

The borehole resulting from drilling operations is typically lined with casing that is cemented into place, and then the well is completed to initiate production of hydrocarbon fluids from the reservoir.

During drilling and production operations, various devices, tubulars, downhole tools, and associated hardware are subject to harsh downhole conditions. For example, downhole tools and devices are often exposed to axial and radial impact loads, friction loads from sliding engagement with outer components, high pressures, corrosive fluids, abrasive fluids, or combinations thereof. Such conditions can detrimentally wear and/or decrease the operating lifetime of such tools and devices. Accordingly, specialized coatings, referred to as metal spray coatings, are often applied to the outer surfaces of such tools and devices to protect them from the harsh conditions.

High-velocity-oxy-fuel WC-10Co-4Cr (HVOF) coatings are one type of conventional metal spray coating used on drilling tools. HVOF coatings do provide enhanced protection, however, common failure modes including blistering, spalling, and cracking have been observed in the field.

Accordingly, there remains a need in the art for improved metal spray coating materials for downhole tools and devices. Such metal spray coating materials would be particularly well received if they provided enhanced yield strength, corrosion resistance, and thermal shock resistance as compared to conventional metal spray coatings.

BRIEF SUMMARY OF THE DISCLOSURE

These and other needs in the art are addressed in one embodiment by a downhole tool. In an embodiment, the downhole tool comprises a body made of a metal or metal alloy. In addition, the downhole tool comprises a coating disposed on the body. The coating includes at least 75 vol % tungsten carbide having an average grain size less than 1.0 μm. The content of tungsten carbide in the coating with a grain size less than 0.5 μm is between 40 and 64 vol % of the coating.

These and other needs in the art are addressed in another embodiment by a method for forming a protective coating on a downhole tool. In an embodiment, the method comprises (a) depositing a metal powder to the downhole tool with a thermal spray system. The metal powder comprises at least 75 vol % tungsten carbide. In addition, the method comprises (b) forming a coating on the downhole tool having a thickness greater than 0.002 in. during (a). Further, the method comprises (c) maintaining the content of tungsten carbide in the coating having a grain size less than 0.5 μm between 40 and 64 vol % of the coating.

These and other needs in the art are addressed in another embodiment by a drilling system. In an embodiment, the system comprises a drill string extending downhole from the rig. In addition, the system comprises a downhole motor coupled to the drillstring. The downhole motor includes a drive section coupled to a bearing assembly. Further, the system comprises a drill bit coupled to the downhole motor. The bearing assembly includes a housing and a mandrel rotatably supported within the housing. The mandrel includes a body and a protective coating deposited on an outer surface of the body. The coating comprises at least 75 vol % tungsten carbide having an average grain size less than 1.0 μm. The content of tungsten carbide in the coating having a grain size less than 0.5 μm is between 40 and 64 vol % of the coating.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION

Figure 1:
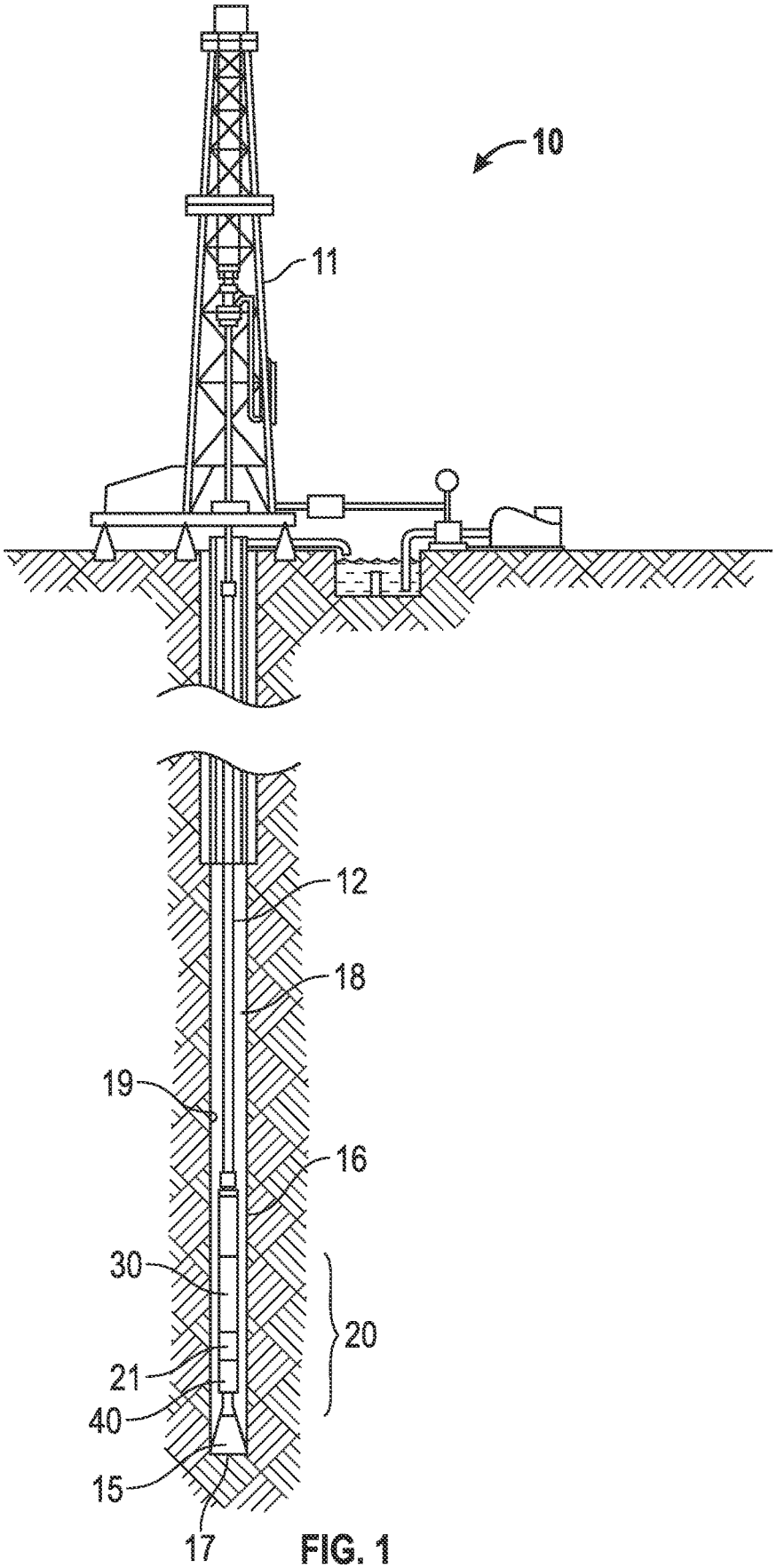
FIG. 1 is a schematic view of an embodiment of a drilling system including a bearing mandrel in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a drilling system 10 for drilling a borehole 16 in an earthen formation is shown. In this embodiment, system 10 includes a drilling rig 11 at the surface, a drill string 12 extending downhole from rig 11, a downhole motor 20, and a drill bit 15 coupled motor 20. Downhole motor 20 includes a hydraulic drive or power section 30, a bent housing 21, and a bearing assembly 40. Motor 20 forms part of the bottomhole assembly (BHA) and is disposed between the lower end of drill string 12 and drill bit 15. The hydraulic drive section 30 converts drilling fluid pressure pumped down the drill string 12 into rotational energy at the drill bit 15. With force or weight applied to the drill bit 15 via the drill string 12 and/or motor 20, also referred to as weight-on-bit (WOB), the rotating drill bit 15 engages the earthen formation and proceeds to form borehole 16 along a predetermined path toward a target zone. The drilling fluid or mud pumped down the drill string 12 and through the motor 20 passes out of the drill bit 15 through nozzles positioned in the bit face. The drilling fluid cools the bit 15 and flushes cuttings away from the face of bit 15. The drilling fluid and cuttings are forced from the bottom 17 of the borehole 16 to the surface through an annulus 18 formed between the drill string 12 and the borehole sidewall 19.

Figure 2:
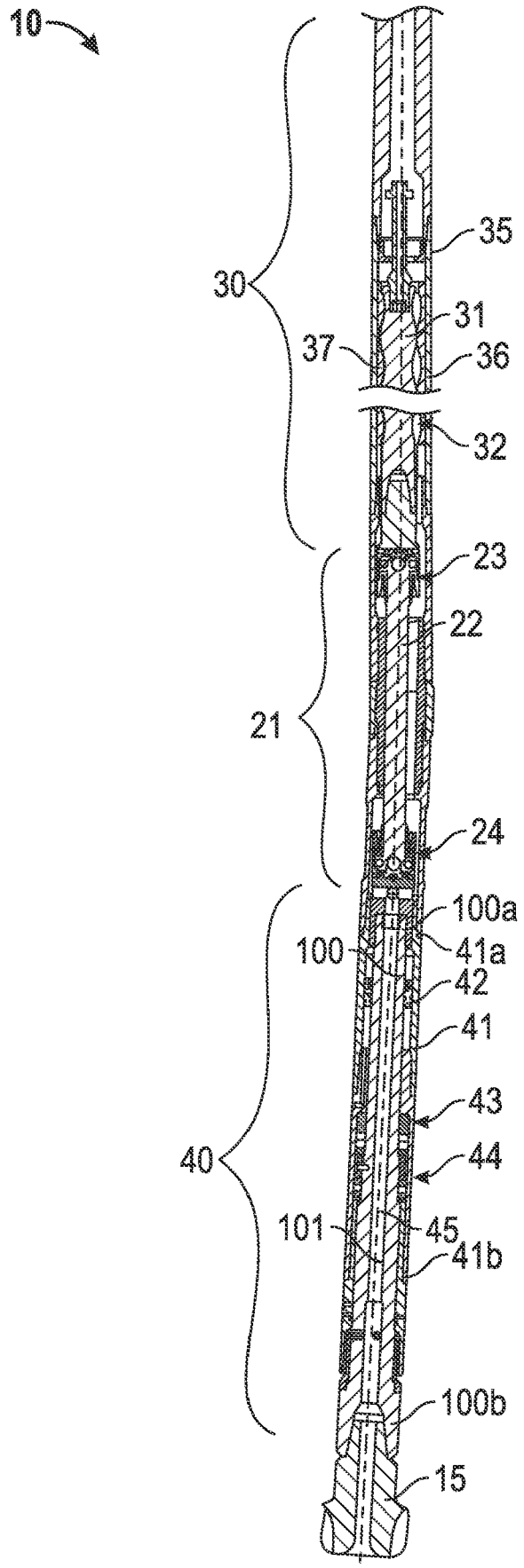
FIG. 2 is a longitudinal cross-sectional view of the downhole motor of FIG. 1.

Referring now to FIG. 2, bent housing 21 is positioned between drive section 30 and bearing assembly 40. Hydraulic drive section 30 includes a helical-shaped rotor 31, preferably made of steel that may be chrome-plated or coated for wear and corrosion resistance, disposed within a stator 35 comprising a heat-treated steel tube 36 lined with a helical-shaped elastomeric insert 37. The helical-shaped rotor 31 defines a set of rotor lobes that intermesh with a set of stator lobes defined by the helical-shaped insert 37. When rotor 31 and stator 35 are assembled, a series of cavities 32 are formed between the helical outer surface of rotor 31 and the helical inner surface of stator 35. Each cavity 32 is sealed from circumferentially adjacent cavities 32 by seals formed along the contact lines between rotor 31 and stator 35.

During operation of the hydraulic drive section 30, fluid is pumped under pressure down drillstring 12 and into the upper end of hydraulic drive section 30 where it fills a first set of open cavities 32. A pressure differential across the adjacent cavities 32 forces rotor 31 to rotate relative to stator 35. As rotor 31 rotates inside stator 35, adjacent cavities 32 are opened and filled with fluid. As this rotation and filling process repeats in a continuous manner, the fluid flows progressively down the length of hydraulic drive section 30 and continues to drive the rotation of rotor 31. A driveshaft 22 disposed within bent housing 21 is coupled to the lower end of rotor 31 with a universal joint 23 is also rotated and is used to rotate drill bit 15.

Referring still to FIG. 2, bearing assembly 40 has a central or longitudinal axis 45, a radially outer bearing housing 41, and a radially inner tubular or mandrel 100 extending axially through housing 41. Bearing housing 41 has a first or upper end 41*a* coupled to bent housing 21, a second or lower end 41*b*, and a central through passage 42 extending axially between ends 41*a*, 41*b*. In this embodiment, bearing housing 41 is formed by a plurality of housing sections coupled together end-to-end.

Mandrel 100 is coaxially disposed within passage 42 of housing 41 and is rotatably supported within housing 41 by a plurality of bearings including on-bottom thrust bearing 43 and off-bottom thrust bearing 44. Mandrel 100 has a first or upper end 100*a*, a second or lower end 100*b*, and a central through passage 101 extending between ends 100*a*, 100*b*. Upper end 100*a* of mandrel 100 is coupled to the lower end of driveshaft 22 with a universal joint 24, and lower end 100*b* of mandrel 100 is coupled to drill bit 15. In this embodiment, upper end 100*a* comprises a pin end and lower end 100*b* comprise a box end. During drilling operations, mandrel 100 is rotated about axis 45 relative to housing 41. In particular, high pressure drilling mud is pumped through power section 30 to drive the rotation of rotor 31, which in turn drives the rotation of driveshaft 22 extending through housing 21, mandrel 100 extending through housing 41, and drill bit 15. The drilling mud flowing through power section 30 flows downstream into upper end 41*a* of housing 41 and through central passage 101 of mandrel 100 in route to drill bit 15.

Figure 3:
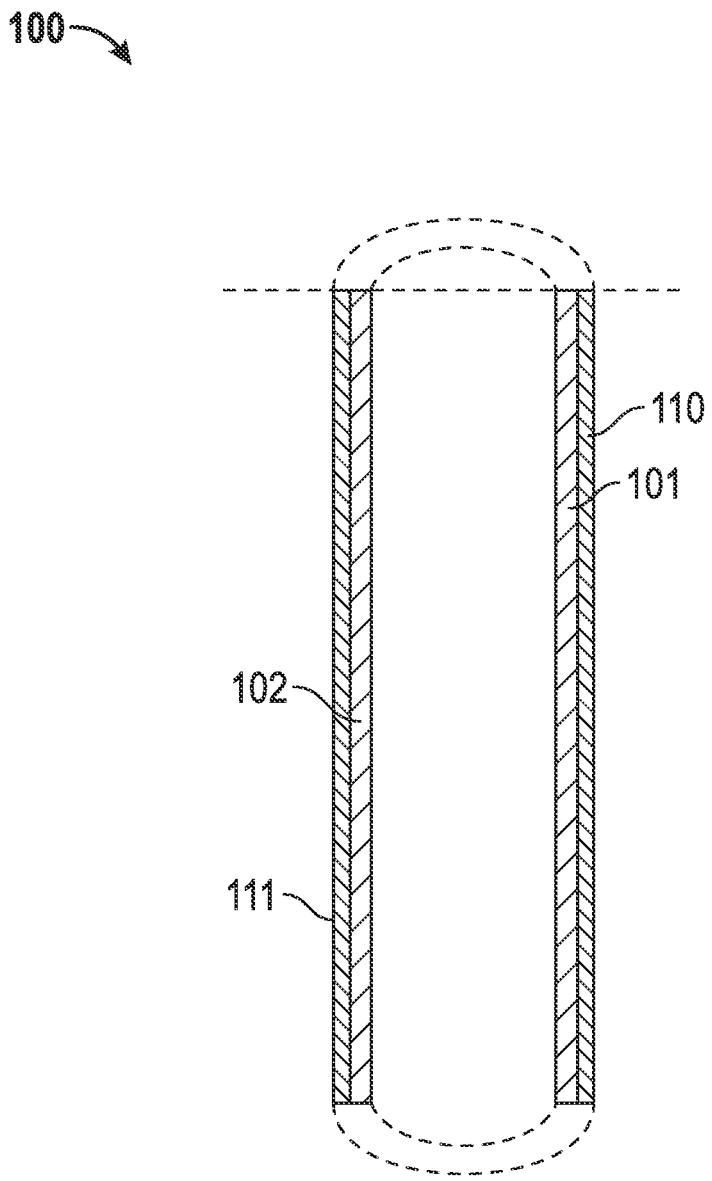
FIG. 3 is a longitudinal cross-sectional view of the mandrel of FIG. 2.

Referring now to FIG. 3, mandrel 100 comprises a cylindrical body 101 and durable wear and corrosion resistant coating 110 disposed about and mounted to body 101. In this embodiment, coating 110 extends around the entire circumference of body 101. Coating 110 can extend axially along the entire length of body 101, or along one or more select axial sections of body 101, depending on where enhanced durability, strength, wear and corrosion resistance is needed. Further, coating 110 can extend over outer surface features on body 101 such as annular shoulders, frustoconical surfaces, etc.

Body 101 is made of a metal or metal alloy base material 102 such as steel, low alloy carbon steel, or the like. Coating 110 is a high-velocity-oxy-fuel (HVOF) coating made of a material 111 having a tungsten carbide (WC) content greater than 75 vol %. In particular, material 111 comprises 10 wt % Cobalt (Co), 4 wt % Chromium (Cr), and the balance being tungsten carbide (WC) (i.e., WC-10Co-4Cr). Such composition for material 111 has a theoretical content of 76.87 vol % WC. HVOF coating 110 is deposited on body 101 with a thermal spray system, and more particular, an High Pressure (HP) HVOF thermal spray system such as Model JP-5000® HP/HVOF® System or Model JP-8000™ available from Praxair Surface Technologies, Inc. of Houston, Tex. As is known in the art, an HVOF thermal spray system operates by continuously feeding and mixing a gaseous or liquid fuel (e.g., methane, propane, acetylene, natural gas, kerosene, etc.) and oxygen fed into a combustion chamber. The mixture is continuously ignited and combusted, and then passed through a converging-diverging nozzle. A metal powder feed stock is injected into the high velocity stream of hot gas, which accelerates and partially melts the metal powder. The stream of hot gas and partially melted powder are directed at a surface to form a coating thereon. In this embodiment, the WC-10Co-4Cr feed powder comprises spheroidized WC particles having grain sizes ranging from 15-45 μm, and material 111, following application of coating 110 onto body 101, comprises WC particles having average grain sizes less than 1.0 μm, and more preferably between 0.4 and 0.8 μm. In addition, for reasons described in more detail below, the content of WC having a grain size less than 0.5 μm in coating 110 is preferably between 40 and 64 vol % of coating 110, and more preferably between 44 and 64 vol % of coating 110. The radial thickness of coating 110 is preferably between 0.002 and 0.020 in.

Four different HVOF coatings were applied and tested to assess the impact of average WC particle grain size on thermal shock resistance, yield strength (resistance to tensile cracking), and sodium chloride (NaCl) corrosion resistance. The four different coatings labeled "A", "B", "C" and "D" are shown in Table 1, along with their respective hardness, average WC particle size (as applied), and estimated mean-free-path. As is known in the art, the estimated mean-free-path refers to the estimated average distance of the cobalt-chromium binder between the tungsten carbide particle boundaries and can be measured using a linear intercept method. Each coating A, B, C, D had a composition of WC-10Co-4Cr (i.e., 10 wt % Co, 4 wt % Cr, with the balance being WC). However, the average WC particle grain size in each coating A, B, C, D was different.

TABLE 1

| WC—10Co—4Cr HVOF Coatings | Knoop Microhardness ($HK_{05}$) | Average WC Particle Grain Size (μm) | Estimated Mean-free-Path (μm) |
|---|---|---|---|
| A | 1267 +/− 118 | >1.2 | 0.7 |
| B | 1211 +/− 108 | 0.8 | 0.4 |
| C | 1258 +/− 131 | 0.4 | 0.15 |
| D | 1291 +/− 64 | <0.2 | 0.1 |

Each coating A, B, C, D was made via HVOF thermal spray deposition on the middle 12.0 in. of the outer surface of a 4.0 in. outer diameter×2.25 in. inner diameter×18 in. length heat treated AISI 4330 steel tubular having a hardness of 34-40 Rc and a yield strength greater than 150 ksi. Each coating A, B, C, D tested was applied in a similar manner. Coatings A and D were applied using the Praxair Surface Technologies, Inc. Model JP-5000® HP/HVOF® System, while coatings B and C were applied using Praxair Surface Technologies, Inc. Model JP-8000™. The deposition parameters for each coating A, B, C, D were 1800-2000 scfh of oxygen, 4-6 gph of kerosene, and 10 lbs/hr of metal powder. The metal powder of each coating Sample A, B, C, D was spheroidized in the range of 15-45 μm. To achieve the smaller average WC particle grain size in coatings B and C as compared to coating A, the metal powder applied to form coatings B and C were cryogenically milled before deposition. The coating A, B, C, D deposited on each tubular was then ground to a finish, and the coated portion of each tubular was cut into 1.0 in. coated axial segments to form multiple samples of each coating A, B, C, D which were then tested and evaluated as described in more detail below.

Figure 4A:
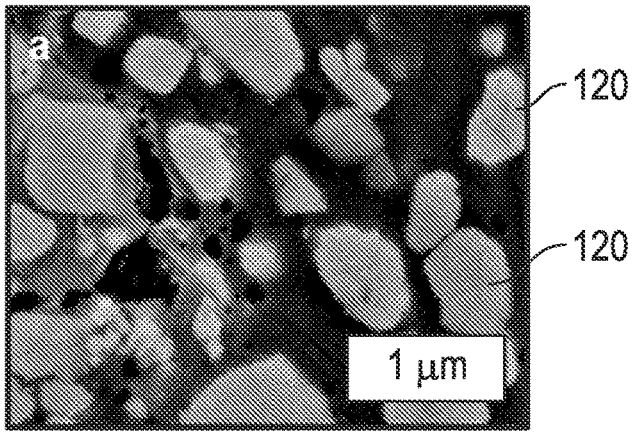
FIGS. 4A-4C are scanning electron microscope photographs of the microstructures of three samples of HVOF WC-10Co-4Cr coatings listed in Table 1.
Figure 4B:
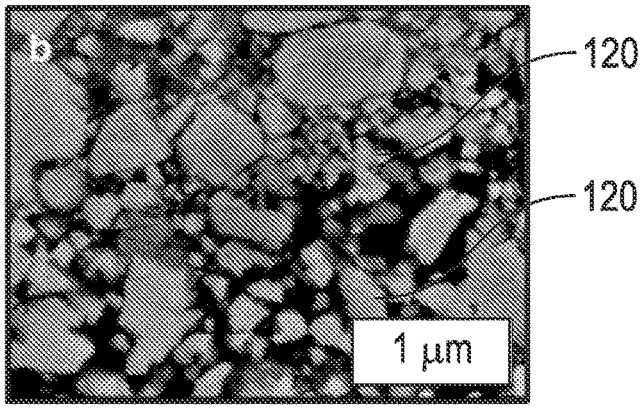
Figure 4C:
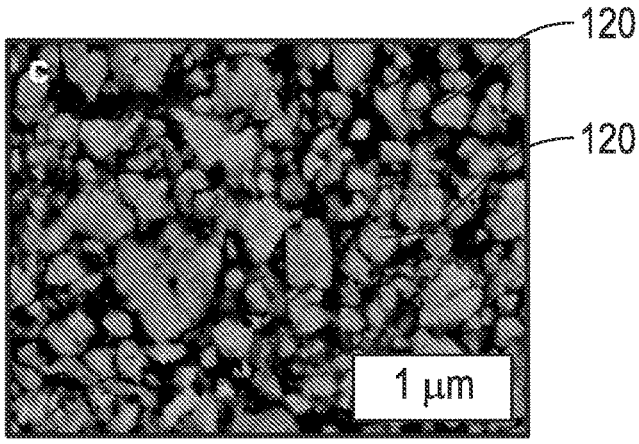

Following deposition of coatings A, B, C, D a scanning electron microscope was used to determine the average WC grain size in each coating A, B, C, D as shown in Table 1. In particular, coating A was a conventional coating having an average WC particle grain size greater than 1.2 μm, coating B had an unconventional average tungsten carbide grain size of 0.8 μm, coating C had an unconventional average tungsten carbide grain size of 0.4 μm, and coating D was a conventional coating having an average tungsten carbide grain size of 0.15 μm. FIGS. 4A-4C illustrate the microstructure and relative sizes of WC grains 120 in each coating A, B, C, respectively. The estimated mean-free-paths and hardness of each coating A, B, C, D were also determined and are shown in Table 1 above.

Figure 5B:
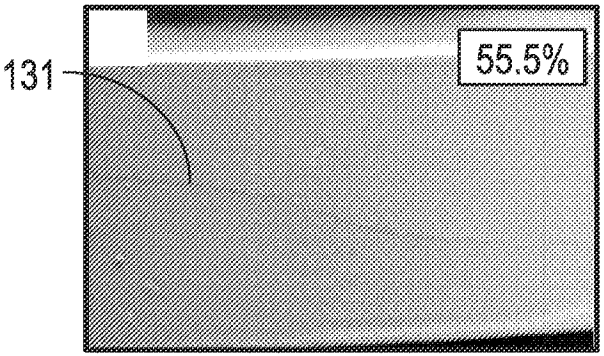
FIGS. 5A-5D are photographs of samples of each of the four HVOF WC-10Co-4Cr coatings listed in Tables 1 and 2 following thermal impact tests and dye penetrant examinations.
Figure 5D:
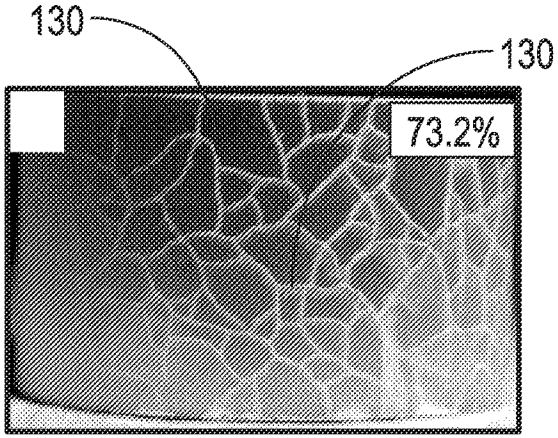
Figure 5A:
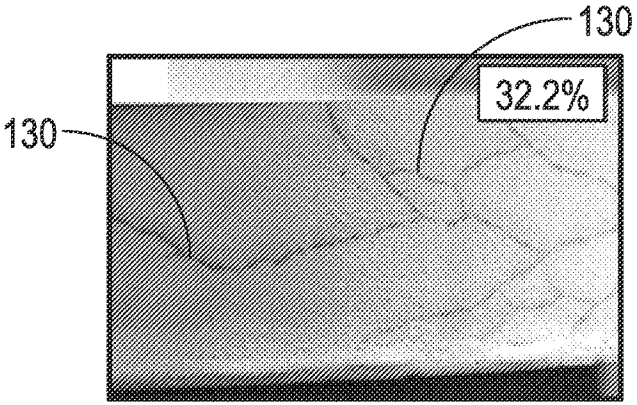
Figure 5C:
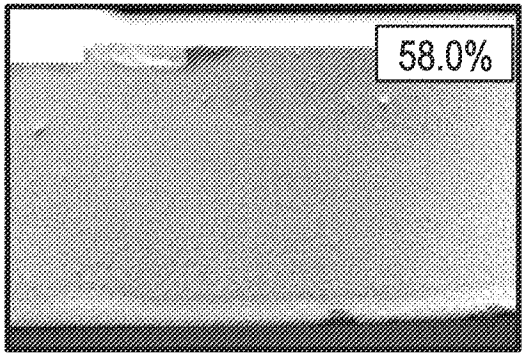

Each coating A, B, C, D was tested for thermal shock resistance via cyclical heating and quenching, and then inspected for surface cracks by dye penetration examination. In particular, samples of each coating A, B, C, D were heated in a furnace to 1000° F. for 60 mins., and then quenched to room temperature in a 25 vol % polymer-water quenching medium comprising polyalkylene polymer quenchant with a pH of 9.0 to 11.0, a specific gravity of 1.101, and a viscosity at 100° F. of about 2700 SUS. Five heating-quenching cycles for each sample of coating A, B, C, D were performed, and then each sample of coating A, B, C, D was subjected to dye penetration examination. As is known in the art, dye penetration examination or inspection is performed by immersing a sample in a florescent or other dye penetrant for a predetermined period of time, optionally washing the dye from the sample, and then viewing the sample under the appropriate lighting to inspect the surface of the sample for cracks that retain the dye. FIGS. 5A-5D are photographs of the surface of a sample of each coating A, B, C, D, respectively, as viewed in the dye penetration examination. As shown in FIG. 5A, the sample of conventional coating A exhibited multiple craze-type cracks 130, the sample of coating B exhibited one longitudinal crack 131, the sample of coating C exhibited no cracks, and the sample of conventional coating F exhibited multiple craze-type cracks 130.

Figure 6A:
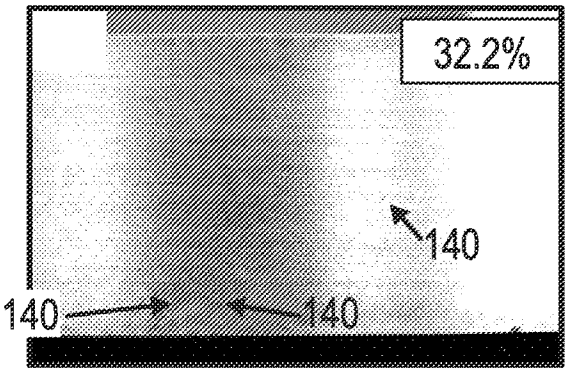
FIGS. 6A-6D are photographs of samples of each of the four HVOF WC-10Co-4Cr coatings listed in Tables 1 and 2 following the corrosion tests.
Figure 6B:
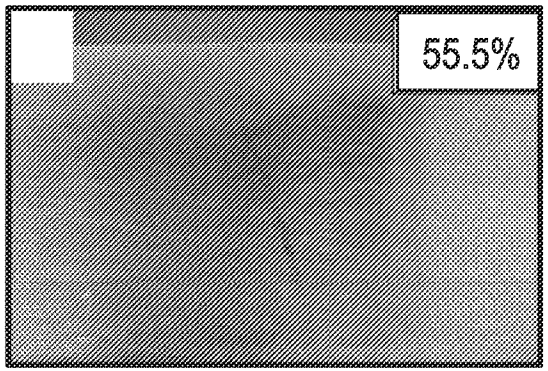
Figure 6C:
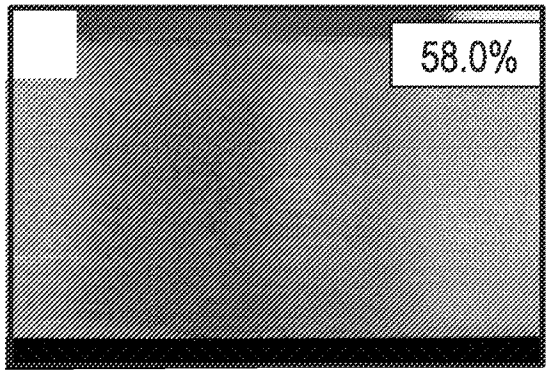
Figure 6D:
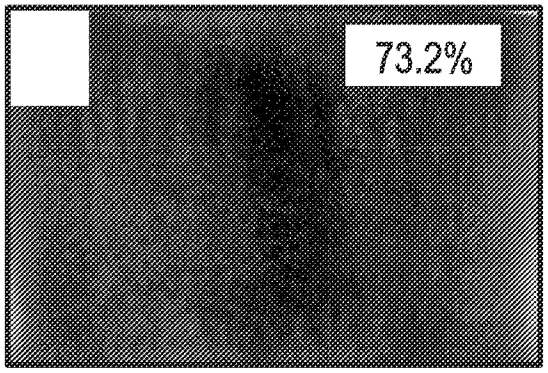

Each coating A, B, C, D was also tested for corrosion resistance. In particular, samples of each coating A, B, C, D were subjected to a 3.5 wt % NaCl solution at 200° F. for 100 hours, and then the surface of each sample was inspected for corrosion pits. FIGS. 6A-6D are photographs of the surface of one sample of each coating A, B, C, D, respectively, following the corrosion tests. As shown in FIG. 6A, the sample of conventional coating A exhibited multiple corrosion pits 140, however, samples of coatings B, C, D did not exhibit any corrosion pits.

The test results described above, and the corresponding results described and shown in FIGS. 5A-5D and 6A-6D indicate that coatings B and C having average WC grain sizes 33% and 66%, respectively, smaller than conventional coating A provided enhanced thermal shock resistance and enhanced corrosion resistance as compared to conventional coating A. In addition, FIGS. 5A-5D indicate that coatings B and C provide enhanced thermal shock resistance and similar corrosion resistance as compared to conventional coating D. Further, the thermal shock tests results suggest coating C had an enhanced yield strength, as compared to coatings A, B, D, which prevented tensile cracking from occurring in coating A during thermal cycling. As shown in FIGS. 4A-C, coatings B and C provide finer as-deposited surface roughness, which may reduce finishing costs as compared to the use of the conventional coating A.

Four different HVOF coatings were applied and tested to assess the impact of the content of WC particles (vol % of the coating) having a grain size less than 0.5 μm on thermal shock resistance, yield strength (resistance to tensile cracking), and sodium chloride (NaCl) corrosion resistance. In particular, samples of coatings A, B, C, D as previously described were tested. Coatings A, B, C, D are shown in Table 2 below, along with their respective vol % of WC particles having a grain size less than 0.5 μm. As previously described, each coating A, B, C, D had a composition of WC-10Co-4Cr (i.e., 10 wt % Co, 4 wt % Cr, with the balance being WC). However, the vol % of each coating A, B, C, D comprising WC particles with a grain size less than 0.5 μm was different.

TABLE 2

| WC—10Co—4Cr HVOF Coatings | Vol % of Coating Comprising WC particles with grain size less than 0.5 μm |
|---|---|
| A | 32.2 |
| B | 55.5 |
| C | 58.0 |
| D | 73.2 |

Following deposition of coatings A, B, C, D, a scanning electron microscope at >2500× magnification was used to determine the vol % of WC particles having a grain size less than 0.5 μm in each coating A, B, C, D as shown in Table 2. In particular, the WC particles having a grain size greater than 0.5 μm were manually identified then input into Simagis quantitative image analysis software to determine the vol % content of WC particles having a grain size less than 0.5 μm in each coating A, B, C, D. The total amount of WC in each coating A, B, C, D was theoretically calculated using laws of mixtures to be 79.9 vol % based on the densities of WC, Co, and Cr and their wt % in the respective coating A, B, C, D. As shown in Table 2, coatings A and D were conventional coatings having a 33.2 and 73.2 vol %, respectively, of WC particles with a grain size less than 0.5 μm. Coating B was an unconventional coating having a 55.5 vol % of WC particles with a grain size less than 0.5 μm, and coating C was an unconventional coating having a 58.0 vol % of WC particles with a grain size less than 0.5 μm.

As previously described, samples of each coating A, B, C, D were tested for thermal shock resistance via cyclical heating and quenching, and then inspected for surface cracks by dye penetration examination. As previously described and shown in FIG. 5A, the sample of conventional coating A exhibited multiple craze-type cracks 130, the sample of coating B exhibited one longitudinal crack 131, the sample of coating C exhibited no cracks, and the sample of conventional coating D exhibited multiple craze-type cracks 130. These test results indicate that coatings B and C having a vol % content of WC with a grain size less than 0.5 μm between about 45 and 64 vol % provided enhanced thermal shock resistance as compared to conventional coatings A and D having a vol % content of WC with a grain size less than 0.5 μm less than 35 vol % and greater than 70 vol %, respectively. In addition, the thermal shock tests results suggest coating C had an enhanced yield strength, as compared to coatings A, B, D, which prevented tensile cracking from occurring in coating C.

Twelve different HVOF coatings were tested and analyzed on scanning electron micrographs to more closely assess the impact of the content of WC particles (vol % of the coating) having a grain size less than 0.5 μm on thermal shock resistance. The twelve different coatings labeled "E", "F", "G", "H", "I", "J", "K", "L", "M", "N", "O", and "P" are shown in Table 3 below, along with their respective vol % of WC particles having a grain size less than 0.5 μm. Each coating E-P had a composition of WC-10Co-4Cr (i.e., 10 wt % Co, 4 wt % Cr, with the balance being WC). However, the vol % of each coating E-P comprising WC particles with a grain size less than 0.5 μm was different.

TABLE 3

| WC—10Co—4Cr HVOF Coatings | Vol % of Coating Comprising WC particles with grain size less than 0.5 μm | Crack Density Following Thermal Impact Test ($mm/cm^2$) |
|---|---|---|
| E | 30-32 | 8-9 |
| F | 32-34 | 8-9 |
| G | 32-34 | 8-9 |
| H | 52-54 | 2-3 |
| I | 54-56 | 2-3 |
| J | 54-56 | 0 |
| K | 56 | 0 |
| L | 58-60 | 2-3 |
| M | 62-64 | 0 |
| N | 70-72 | 22-23 |
| O | 72-74 | 22-23 |
| P | 74-76 | 22-23 |

Following deposition of coatings E-P, the vol % of each coating E-P comprising WC particles having a grain size less than 0.5 μm were determined as previously described for coatings A, B, C, D. As shown in Table 3, coatings E-G were conventional coatings having 30-34 vol %, respectively, of WC particles with a grain size less than 0.5 μm, coatings H-M were unconventional coatings having 50-64 vol % of WC particles with a grain size less than 0.5 μm, and coatings N-P were conventional coatings having greater than 70 vol % of WC particles with a grain size less than 0.5 μm.

Each coating E-P was tested for thermal shock resistance via cyclical heating and quenching, and then inspected for surface cracks by dye penetration examination in the same manner as previously described. Namely, five cycles of heating samples of each coating E-P to 1000° F. for 60 mins., and then quenching the samples of each coating E-P to room temperature in a 25% polymer were performed, and then each sample of coating E-P was subjected to dye penetration examination. For those samples E-P that exhibited cracks following the thermal impact tests, a crack density equal to the average crack length per unit area was determined, and is shown in Table 3 above.

Figure 7:
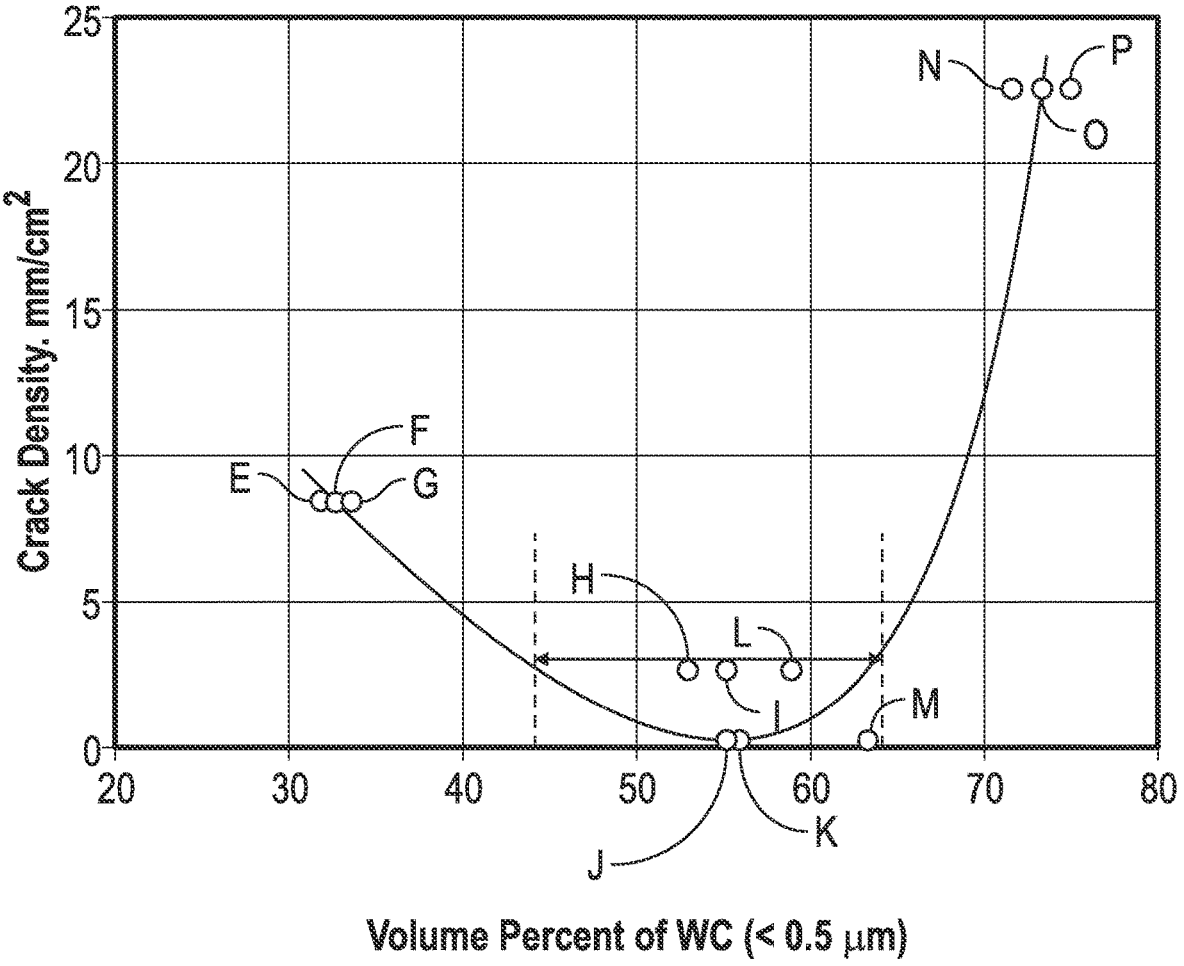
FIG. 7 is a graphical illustration of crack density as a function of the volume percent of tungsten carbide having a size less than 0.5 μm in samples of each of the HVOF WC-10Co-4Cr coatings listed in Table 3.

FIG. 7 is a graphical illustration of the measured crack density ($mm/cm^2$) as a function of the vol % of WC in each coating E-P having a grain size less than 0.5 μm. As shown in FIG. 7, coatings having a relatively high content (greater than about 70 vol %) of WC with a grain size less than 0.5 μm (e.g., conventional coatings N, 0, P) exhibited a relatively high crack densities, which indicated poor thermal shock resistance and poor yield strength (i.e., these coatings were more prone to tensile cracking nucleation and propagation). Likewise, coatings having a relatively low content (less than about 40 vol %) of WC with a grain size less than 0.5 μm (e.g., conventional coatings E, F, G) exhibited a relatively high crack densities, which indicated poor thermal shock resistance and poor yield strength (i.e., these coatings were more prone to tensile cracking nucleation and propagation). However, coatings having a moderate or intermediate content (between about 44 and 64 vol %) of WC with a grain size less than 0.5 μm (e.g., unconventional coatings H-M) exhibited very low crack densities, which indicated good thermal shock resistance and good yield strength (i.e., tensile cracking did not occur or only occurred to a very limited extent). Based on these test results, embodiments of HVOF WC-10Co-4Cr coatings described herein preferably have a content of WC with a grain size less than 0.5 μm between 40 and 64 vol %, and more preferably between 44 and 64%.

FIGS. 2 and 3 previously described HVOF WC-10Co-4Cr metal spray coating 110 provided on bearing mandrel 100 to enhance wear resistance, thermal shock resistance, yield strength, and overall durability. However, it should be appreciated that embodiments of HVOF WC-10Co-4Cr coatings in accordance with the principles described herein may be applied to a multitude of other tools and devices for which enhanced wear resistance, thermal shock resistance, yield strength and overall durability is desired including, without limitation, mandrels (e.g., knocker mandrels, splined mandrels), downhole tools and drilling equipment (e.g., reamers, under-reamers, V-stabs, centralizers, and the like), drill collars, drill bits, drilling jars, extenders, shock tools, slack joints, motion compensators, stabilizers, wipers, fishing tools, intervention tools, completion tools, service equipment, directional tools, borehole enlargement tools, coring tools, bushings, and bearings (e.g., radial bearings, needle bearings, thrust bearings, ball bearings, roller bearings, etc.). Moreover, although FIG. 3 disclose the application of HVOF WC-10Co-4Cr metal spray coating 110 on the radially outer surfaces of mandrel 100, embodiments of HVOF WC-10Co-4Cr metal spray coatings described herein may also be applied to other surfaces such as radially inner surfaces.

Figure 8:
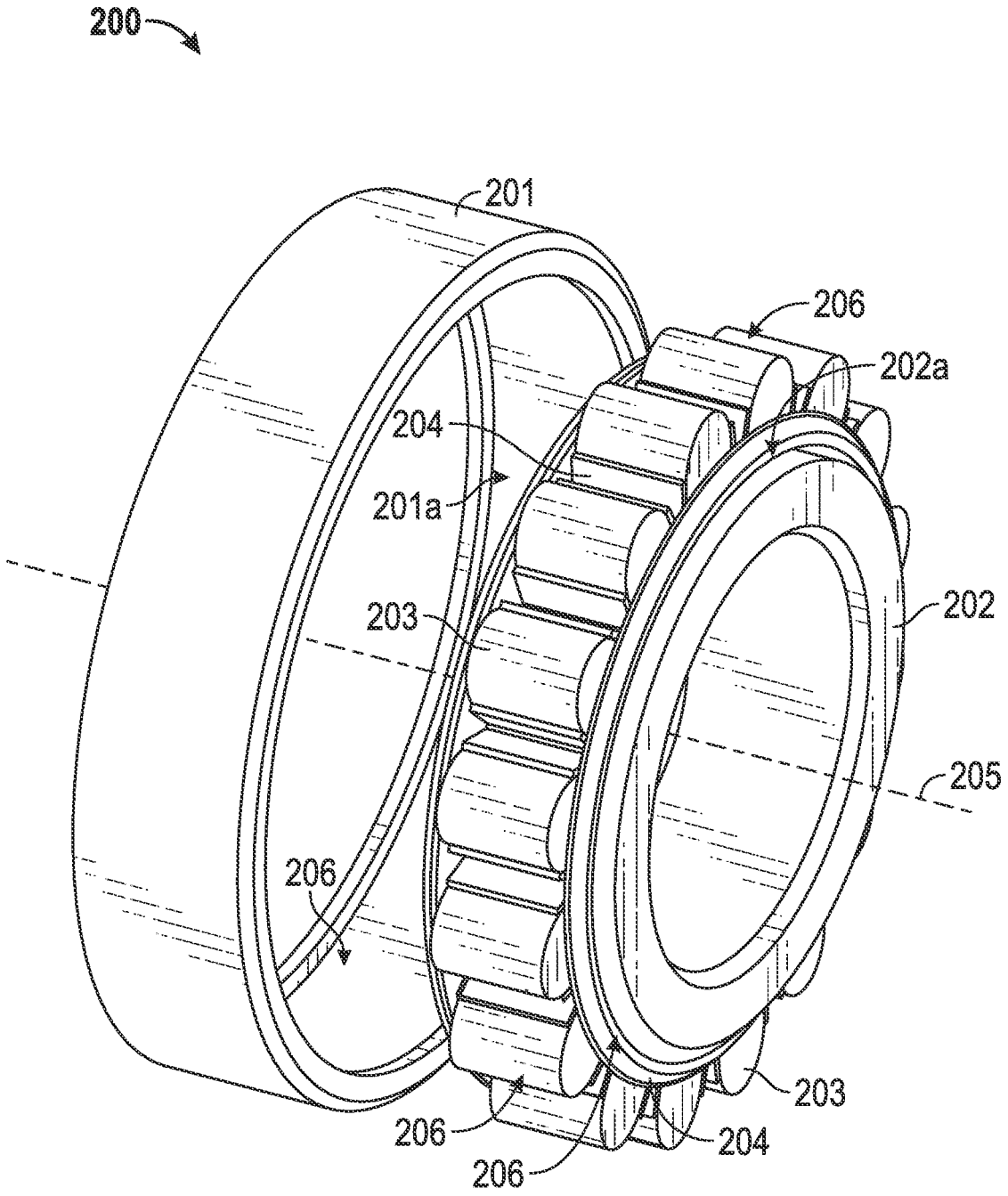
FIG. 8 is an exploded view of an embodiment of a radial bearing including an HVOF WC-10Co-4Cr coating in accordance with the principles described herein.

Referring now to FIG. 8, a radial bearing 200 for supporting radial loads while allowing relative rotation between two components is shown. Radial bearing 200 is a roller bearing having a central axis 205 and including an outer race 201, an inner race 202 disposed within outer race 201, and a plurality of circumferentially spaced roller elements 203 radially positioned between races 201, 202. Race 201 is a ring including an annular recess or groove 201*a* on its inner surface, and race 202 is a ring including an annular recess or groove 202*a* on its outer surface. Roller elements 203 are seated in recesses 201*a*, 202*a*, which restrict roller elements 203 from moving axially relative to races 201, 202. A cage 204 is provided between races 201, 202 to maintain the circumferential spacing of roller elements 203.

In operation, races 201, 202 rotate about axis 205 relative to each other, and roller elements 203 roll in recesses 201*a*, 202*a*. Roller elements 203 support radial loads while allowing races 201, 202 to roll with very little rolling resistance and sliding. Contact between races 201, 202 and roller elements 203 under radial load over time can wear and/or dent races 201, 202 and roller elements 203, as well as increase the temperature of races 201, 202 and roller elements 203. Thus, to enhance resistance to wear and thermal stresses, an HVOF WC-10Co-4Cr metal spray coating 206 made of material 111 previously described is applied to races 201, 202 in grooves 201*a*, 202*a*, respectively, and applied to the outer surfaces of roller elements 203. As previously described, material 111 comprises WC particles having average grain sizes less than 1.0 μm, and more preferably between 0.4 and 0.8 μm. In addition, the content of WC with a grain size less than 0.5 μm in material 111 is preferably between 40 and 64 vol %, and more preferably between 44 and 64%. Although radial bearing 200 is a cylindrical roller bearing, coating 206 may also be applied to contact surfaces between races and roller elements in other types of bearings such as radial ball bearings, thrust bearings, tapered roller bearings, etc.

As previously described, HVOF WC-10Co-4Cr metal spray coatings comprise 10 wt % Co, 4 wt % Cr, and the balance being WC (i.e., 86 wt % WC). However, it should be appreciated these contents of Co, Cr, and WC are theoretical, and the actual coating may have contents that vary slightly. For example, an actual HVOF WC-10Co-4Cr metal spray coating may comprise 10.1 wt % Co, 3.9 wt % Cr, and the balance being WC. Thus, although embodiments of the HVOF WC-10Co-4Cr metal spray coatings described herein have a content of WC with a grain size less than 0.5 μm preferably between 40 and 64 vol % of the coating, and more preferably between 44 and 64 vol % of the coating, it should be appreciated that such "sweet spots" for the content of WC with a grain size less than 0.5 μm apply equally despite such slight variations in Co and Cr in the coating.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole tool, comprising:

a body made of a metal or metal alloy;

a coating disposed on the body;

wherein the coating includes at least 75 vol % tungsten carbide having an average grain size less than 1.0 μm; and wherein the coating includes only 40 to 64 vol % tungsten carbide with a grain size less than 0.5 μm.

2. The downhole tool of claim 1, wherein the coating includes about 10 wt % cobalt and about 4 wt % chromium.

3. The downhole tool of claim 2, wherein the coating is a high-velocity-oxy-fuel coating.

4. The downhole tool of claim 3, wherein the tungsten carbide has an average grain size between 0.4 and 0.8 μm.

5. The downhole tool of claim 3, wherein the content of tungsten carbide with a grain size less than 0.5 μm is between 44 and 64 vol % of the coating.

6. The downhole tool of claim 3, wherein the body is made of steel.

7. The downhole tool of claim 3, wherein the coating has a thickness between 0.002 and 0.020 in.

8. A method for forming the downhole tool of claim 1, the method comprising:

(a) depositing a metal powder on the body with a thermal spray system, the metal powder comprising at least 75 vol % tungsten carbide;

(b) forming the coating on the body having a thickness greater than 0.002 in. during (a);

(c) maintaining the content of tungsten carbide in the coating having the grain size less than 0.5 μm between 40 and 64 vol % of the coating.

9. The method of claim 8, wherein the metal powder comprises about 10 wt % cobalt and about 4 wt % chromium.

10. The method of claim 9, further comprising maintaining the average grain size of the tungsten carbide in the coating less than 1.0 μm.

11. The method of claim 10, further comprising maintaining the average grain size of the tungsten carbide in the coating between 0.4 and 0.8 μm.

12. The method of claim 10, wherein (c) comprises maintaining the content of tungsten carbide in the coating having a grain size less than 0.5 μm between 44 and 64 vol % of the coating.

13. The method of claim 11, further comprising cryogenically milling the metal powder before (a).

14. The method of claim 13, wherein the downhole tool comprises a mandrel or a bearing.

* * * * *